US008919675B2

(12) United States Patent
Sakata et al.

(10) Patent No.: US 8,919,675 B2
(45) Date of Patent: Dec. 30, 2014

(54) FUEL INJECTION VALVE

(75) Inventors: Yukitaka Sakata, Chiyoda-ku (JP); Naoya Hashii, Chiyoda-ku (JP); Kyosuke Watanabe, Chiyoda-ku (JP); Tsuyoshi Munezane, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 347 days.

(21) Appl. No.: 13/279,416

(22) Filed: Oct. 24, 2011

(65) Prior Publication Data

US 2012/0325938 A1 Dec. 27, 2012

(30) Foreign Application Priority Data

Jun. 24, 2011 (JP) ..... 2011-140132

(51) Int. Cl.

| | |
|---|---|
| ***F02M 61/00*** | (2006.01) |
| ***B05B 1/30*** | (2006.01) |
| ***F02M 51/00*** | (2006.01) |
| ***F02M 61/18*** | (2006.01) |

(52) U.S. Cl.

CPC ..... *F02M 61/1853* (2013.01); *F02M 61/1846* (2013.01); *F02M 61/188* (2013.01); *F02M 61/1806* (2013.01); *F02M 61/1886* (2013.01)

USPC ..... 239/533.12; 239/585.1; 239/585.4; 239/533.3; 239/5

(58) Field of Classification Search

CPC ..... F02M 61/1853; F02M 61/1806; F02M 61/1846; F02M 61/188

USPC ..... 239/533.12, 552, 585.4, 596, 5, 11

See application file for complete search history.

(56) References Cited

U.S. PATENT DOCUMENTS

| | | | | |
|---|---|---|---|---|
| 5,762,272 | A | 6/1998 | Tani et al. | |
| 6,848,636 | B2 * | 2/2005 | Munezane et al. | 239/533.12 |
| 8,191,800 | B2 * | 6/2012 | Kitagawa et al. | 239/533.12 |
| 8,302,886 | B2 * | 11/2012 | Hashii et al. | 239/533.12 |
| 2004/0074996 | A1 | 4/2004 | Munezane et al. | |
| 2010/0193612 | A1 * | 8/2010 | Schrade et al. | 239/533.12 |

FOREIGN PATENT DOCUMENTS

| | | | |
|---|---|---|---|
| JP | 3183156 | B2 | 7/2001 |
| JP | 2001-317431 | A | 11/2001 |
| JP | 2004-137931 | A | 5/2004 |
| JP | 3759918 | B2 | 3/2006 |
| JP | 2010-138914 | A | 6/2010 |

OTHER PUBLICATIONS

Japanese Office Action issued Dec. 18, 2012, in Patent Application No. 2011-140132.

* cited by examiner

*Primary Examiner* — Len Tran
*Assistant Examiner* — Alexander Valvis
(74) *Attorney, Agent, or Firm* — Sughrue Mion, PLLC

(57) ABSTRACT

At the downstream-side face of an injection hole plate, a plurality of concaves are arranged corresponding to a plurality of injection holes; at least part of an injection hole outlet opens at the plain of the concave; the rest of the outlet opens at the downstream side face of the injection hole plate or contacts the inner surface of the concave. In a flow path formed by the injection hole, there is provided a cylindrical portion, whose cross section is the radially minimum cross section of the injection hole, from the upstream side face of the injection hole plate to the plain of the concave. Where D1 denotes the diameter of the injection hole and D2 denotes the diameter of the concave or the diameter of the concave in the circumferential direction of the virtual circle, the relationship 1.1<(D2/D1)<3.0 is satisfied.

1 Claim, 8 Drawing Sheets

(a)

(b) E-E CROSS SECTION (c) F-F CROSS SECTION (d)

FUEL INJECTION VALVE

BACKGROUND OF THE INVENTION

1. Field of the Invention

The present invention relates to a fuel injection valve, of an electromagnetic type, for example, that is mainly utilized in a fuel supply system.

2. Description of the Related Art

In recent years, while the regulation on exhaust gas of a vehicle or the like has been tightened, it has been required to raise the combustion efficiency of an internal combustion engine. In general, the particle diameter (spray particle diameter) of fuel injected from a fuel injection valve and the angle (spray angle) of the liquid film of the injected fuel are in a tradeoff relationship as represented in FIG. 1; in order to reduce the spray particle diameter, it is required to enlarge the spray angle. In a fuel-injection internal combustion engine, a fuel injection valve injects a fuel toward an intake valve, and the fuel, which attaches to the intake valve and hence is gasified, is supplied to a combustion chamber. However, when the fuel is sprayed, part of the spray, situated at a position that is away from the center axis of the spray, attaches to the inner wall of an intake port; therefore, some of the fuel travels on the inner wall of the intake port, becomes a liquid film, and flows into the combustion chamber in a delayed manner, thereby hindering the combustion efficiency from being raised.

When in order to reduce the particle diameter of the fuel, the spray angle is made too large, the amount of spray that attaches to the inner wall of the intake port increases and hence there increases the fuel that travels on the inner wall of the intake port, becomes a liquid film, and flows into the combustion chamber in a delayed manner; therefore, the combustion efficiency decreases. Accordingly, in order to raise the combustion efficiency, it is required that both the directivity and the atomization of the spray are satisfied. In order to satisfy both the directivity and the atomization of the spray, various kinds of studies have already been carried out to date.

For example, in a conventional fuel injection valve disclosed in Patent Document 1, there is provided, in an injection hole plate, a protrusion portion that protrudes downstream in such a way as to be parallel to the valve-body front end portion, and the injection hole right above height, expressed by the distance in the valve seat axis direction between the center of the inlet of an injection hole disposed radially outside the protrusion portion and the valve-body front end portion, and the diameter of the injection hole are made to be in a predetermined relationship with each other, so that both the directivity and the atomization of the spray are satisfied. Moreover, in a conventional fuel injection valve disclosed in Patent Document 2, a concave is provided at the outlet of each injection hole in order to promote the mixture of the fuel and air, so that the atomization of the fuel is facilitated.

Furthermore, in a conventional fluid injection nozzle disclosed in Patent Document 3, an injection hole, provided in an injection hole plate, is disposed inside a virtual circle obtained when the extended line of the seat surface of a valve seat and the injection hole plate intersect each other, and the diameter of the injection hole and the vertical distance between the valve-body front end portion and the injection hole plate are made to be in a specific relationship with each other, so that the atomization is facilitated. Still moreover, in a conventional fluid injection nozzle disclosed in Patent Document 4, an injection hole is enlarged toward the fluid outlet with respect to the axis of the injection hole, so that a liquid film, sufficiently widened in the injection hole, can be obtained.

PRIOR ART REFERENCE

Patent Document

[Patent Document 1] Japanese Patent Application Laid-Open No. 2010-138914
[Patent Document 2] Japanese Patent No. 3759918
[Patent Document 3] Japanese Patent No. 3183156
[Patent Document 4] Japanese Patent Application Laid-Open No. 2001-317431

In the case of the conventional fuel injection valve disclosed in Patent Document 1, when the valve body opens, the fuel that has passed through a gap between the valve-body front end portion and the seat surface of the valve seat and then has flowed into the injection hole is pushed against the injection-hole inner wall at a position that is radially closer to the valve seat axis than the rest portion thereof, whereby the fuel is converted into a flow that is along the curvature of the injection hole; however, in order to make the fuel become a crescent-shaped thin liquid film and inject it from the injection hole, it is required to optimize the length of the injection hole. For example, in the case where the length of the injection hole is too long, the fuel turn around inside the hole and becomes streaky spray; in the case where the length of the injection hole is too short, the conversion of the flow of the fuel into a flow that is along the curvature of the injection hole cannot sufficiently be performed, whereby also in this case, the fuel becomes streaky spray.

In a fuel injection valve in which sprays of the fuel injected from a plurality of injection holes formed in an injection hole plate form a single or more collective sprays, the angle (injection hole angle) between a straight line that passes through the center of the injection hole inlet and the center of the injection hole outlet and the valve seat axis differs depending on an individual injection hole. Accordingly, in the conventional device disclosed in Patent Document 1, the respective lengths of injection holes are different from one another; thus, when the thickness of the injection hole plate is set in such a way that the length of one injection hole is optimized, the length of another injection hole is not optimized, whereby there has been a problem that the spray becomes streaky and hence the atomization is not facilitated.

The conventional fuel injection valve disclosed in Patent Document 2 is configured in such a way that the length of the injection hole that is radially closer to the valve seat axis is longer than the length of the injection hole that is radially farther from the valve seat axis; the conventional fuel injection valve disclosed in Patent Document 3 is configured in such a way that an injection hole provided in the injection hole plate is disposed inside a virtual circle. By taking a magnified picture of fuel injected from an injection hole, in order to figure out the mechanism of fuel-injection atomization, it is known that in a fuel split process, because force that disperses the fuel overcomes the surface tension, the fuel splits from "a liquid film" into "liquid threads" and then from "a liquid thread" into "liquid droplets"; in addition, it is also known that once the fuel becomes "a liquid droplet", the effect of the surface tension becomes large and hence the split becomes unlikely to occur. Therefore, it is known that by injecting from an injection hole a fuel as a low-turbulence thin liquid film and making this liquid film split after widening it to be thinner, the atomization is facilitated, and when in contrast, turbulence occurs in the fuel flow, the fuel splits as a thick liquid film before the fuel liquid film is thinly widened and hence the liquid droplet after the split becomes large.

In the conventional device disclosed in Patent Document 2, the length of injection hole that is radially closer to the valve seat axis is longer than the length of the injection hole that is farther from the valve seat axis. The fuel that has filled the injection hole is mixed with a great deal of air before being injected, splits, and becomes liquid droplets; however, there has been a problem that even though the fuel that has filled the injection hole is split, the liquid droplet is large and hence is not atomized.

In each of the conventional fuel injection valves disclosed in Patent Documents 2 and 3, when the valve body opens, the flow of the fuel that passes through a gap between the valve-body front end portion and the seat surface of the valve seat and then flows into the injection hole and the flow that passes by the injection holes and is made to turn around by an opposing flow at the center of the injection hole plate collide head on with each other right above the injection hole; therefore, there has been a problem that turbulence is caused in the flow of the fuel and this turbulence deteriorates the droplet diameter.

In the conventional collision disclosed in Patent Document 4, a taper-shaped injection hole is formed; however, the change in the machining condition for forming this injection hole may from time to time cause the area of the injection hole inlet to be liable to vary; thus, there has been a problem that the flow rate characteristics (the static flow rate and the dynamic flow rate) and the fuel spray characteristics (the spray shape and the spray particle diameter) are likely to vary. Moreover, there has been a problem that because extremely complicated processes are required in manufacturing and size management, the production costs for the fuel injection valve increase.

As a method for solving these problems, there can be conceived an idea of adding the technology disclosed in Patent Document 2 to the technology disclosed in Patent Document 1. Accordingly, the fuel flow that passes through a gap between the valve-body front end portion and the seat surface of the valve seat and then flows into an injection hole, when the valve body opens, can crawl under the U-turn flow that passes by injection holes, that is made to turn around by an opposing flow at the center of the injection hole plate, and that is issued along the cavity form of the protrusion portion from the radially outmost portion of the protrusion portion; thus, the fuel flow, keeping a rapid flow rate, flows into the injection hole without colliding head on with the U-turn flow, and then is injected after being pushed against the injection hole inner wall that is radially closer to the valve seat axis. In this situation, the fuel that has been pushed against the injection hole inner wall is converted into a flow that is along the curvature of the injection hole and becomes a thin film, which is a crescent-shaped liquid film.

In the foregoing Patent Document 2, in order to facilitate the mixture of the fuel and air, a concave is formed in an injection hole; in this conventional fuel injection valve, because when the fuel flows into the concave, the diameter of the injection hole is enlarged, there is demonstrated an effect that a liquid film is further widened to become a thin film. Accordingly, even when the respective lengths of injection holes are different from one another, the fuel does not make a round of the inside of the injection hole, whereby it is made possible to facilitate the atomization in all the injection holes. However, in the technology disclosed in Patent Document 2, a fuel injection valve has a structure in which a concave is added to an injection hole formed in an injection hole plate having a protrusion portion that protrudes downstream in parallel with the valve-body front end portion; therefore, there exist the following problems.

(1) The diameter of the concave: that is to say, there exists a problem that in the case where the diameter of the concave is too small in comparison to the diameter of an injection hole, the rate of enlargement, of the injection hole diameter, that is caused by adding the concave becomes small, whereby the fuel cannot sufficiently be thinned and hence the atomization is not facilitated, and in the case where the diameter of the concave is too large, the difference between the curvature of the injection hole and the curvature of the concave becomes large and hence the fuel departs from the injection hole before being widened from the injection hole to the concave, whereby the fuel cannot sufficiently be thinned and hence the atomization is not facilitated.

(2) The depth of the concave: there exists a problem that in the case where the depth of the concave is too small in comparison to the thickness of the injection hole plate, the fuel is injected before being sufficiently thinned in the concave and hence the atomization is not facilitated, and in the case where the depth is too large, there cannot be secured, in the injection hole flow path from the upstream side face of the injection hole plate to the concave, a cylindrical portion where the area of the cross section becomes minimum and hence the injection hole shape at the minimum cross section portion becomes a distorted shape as represented in FIG. 5(D), whereby turbulence is caused in the fuel flow and hence the turbulence deteriorates the particle diameter. In addition, there exists a problem that the variation in the concave form makes the area of the flow path vary, whereby the flow rate varies.

(3) The ratio of the portion, of an injection hole, that is stridden over by the concave: there exists a problem that in the case where the ratio of the portion, of an injection hole, that is stridden over by the concave is too small, the amount of the fuel that flows from the injection hole into the concave becomes small, whereby the fuel cannot sufficiently be thinned and hence the atomization is not facilitated, and in the case where the ratio is too large, the length of the injection hole that is radially closer to the valve seat axis becomes small and hence the fuel is injected before being sufficiently converted into a flow that is along the curvature of the injection hole, whereby not only streaky spray is produced but also the directivity of the spray cannot be secured, and hence the angle of the injected spray becomes smaller than a desired angle.

SUMMARY OF THE INVENTION

The present invention has been implemented in order to solve the problems in the foregoing conventional fuel injection valves; the objective thereof is to provide a fuel injection valve that can realize both the directivity of spray in the spray characteristics thereof and the atomization and that raises the flow rate accuracy in the flow rate characteristics.

A fuel injection valve according to the present invention is configured in such a way that there is provided a valve body that makes contact with or departs from a seat surface of a valve seat, and when in response to an operation signal from a control system, the valve body is operated so as to depart from the seat surface of the valve seat, a fuel passes between the valve body and the seat surface of the valve seat and then is injected outward from a plurality of injection holes provided in an injection hole plate fixed to the valve seat; the fuel injection valve is characterized in that the seat surface of the valve seat is formed in such a way that the inner diameter thereof decreases in a direction from an upstream side to a downstream side of a flow of the fuel; the injection hole plate is disposed opposing a front end portion of the valve body in such a way that a virtual extension seat surface extended along the seat surface from a downstream edge of the seat surface and an upstream side face of the injection hole plate intersect each other to form a virtual circle, and is provided with a protrusion portion where a segment thereof that opposes the front end portion of the valve body protrudes downstream with a predetermined gap from the surface of the front end portion of the valve body; the protrusion portion is provided in the injection hole plate in such a way as to be situated radially inside the virtual circle; each of the plurality of injection holes provided in the injection hole plate is formed in such a way that the diameter thereof is constant from an injection hole inlet that opens at the upstream side face of the injection hole plate to an injection hole outlet; the injection hole inlet is disposed in such a way as to be radially closer to the center axis of the valve seat than the injection hole outlet; the center of the injection hole inlet that opens at the upstream side face of the injection hole plate is disposed radially inside the inner wall of the opening portion, of the valve seat, that has the minimum inner diameter of the valve seat, and radially outside the protrusion portion; at the downstream side face of the injection hole plate, there is provided a plurality of concaves arranged corresponding to the plurality of injection holes, in such a way that the length of the injection hole that is situated radially farther from the center axis of the valve seat is shorter than the length of the injection hole that is situated radially closer to the center axis of the valve seat; at least part of the injection hole outlet opens at the plain of the concave and the rest of the injection hole outlet opens at the downstream side face of the injection hole plate or makes contact with the inner surface of the concave; in a flow path formed by the injection hole, there is provided a cylindrical portion, whose cross section is the radially minimum cross section of the injection hole, from the upstream side face of the injection hole plate to the plain of the concave; and assuming that D1 denotes the diameter of the injection hole and D2 denotes the diameter of the concave or the diameter of the concave in the circumferential direction of the virtual circle, the relationship $1.1<(D2/D1)<3.0$ is satisfied.

A fuel injection valve according to the present invention is configured in such a way that there is provided a valve body that makes contact with or departs from a seat surface of a valve seat, and when in response to an operation signal from a control system, the valve body is operated so as to depart from the seat surface of the valve seat, a fuel passes between the valve body and the seat surface of the valve seat and then is injected outward from a plurality of injection holes provided in an injection hole plate fixed to the valve seat; the fuel injection valve is characterized in that the seat surface of the valve seat is formed in such a way that the inner diameter thereof decreases in a direction from an upstream side to a downstream side of a flow of the fuel; the injection hole plate is disposed opposing a front end portion of the valve body in such a way that a virtual extension seat surface extended along the seat surface from a downstream edge of the seat surface and an upstream side face of the injection hole plate intersect each other to form a virtual circle, and is provided with a protrusion portion where a segment thereof that opposes the front end portion of the valve body protrudes downstream with a predetermined gap from the surface of the front end portion of the valve body; the protrusion portion is provided in the injection hole plate in such a way as to be situated radially inside the virtual circle; each of the plurality of injection holes provided in the injection hole plate is formed in such a way that the diameter thereof is constant from an injection hole inlet that opens at the upstream side face of the injection hole plate to an injection hole outlet; the injection hole inlet is disposed in such a way as to be radially closer to the center axis of the valve seat than the injection hole outlet; the center of the injection hole inlet that opens at the upstream side face of the injection hole plate is disposed radially inside the inner wall of the opening portion, of the valve seat, that has the minimum inner diameter of the valve seat, and radially outside the protrusion portion; at the downstream side face of the injection hole plate, there is provided a plurality of concaves arranged corresponding to the plurality of injection holes, in such a way that the length of the injection hole that is situated radially farther from the center axis of the valve seat is shorter than the length of the injection hole that is situated radially closer to the center axis of the valve seat; at least part of the injection hole outlet opens at the plain of the concave; the rest of the injection hole outlet opens at the downstream side face of the injection hole plate or makes contact with the inner surface of the concave; in a flow path formed by the injection hole, there is provided a cylindrical portion, whose cross section is the radially minimum cross section of the injection hole, from the upstream side face of the injection hole plate to the plain of the concave; and assuming that T1 denotes the thickness of the injection hole plate and T2 denotes the depth of the concave, the relationship $0.1<(T2/T1)<0.8$ is satisfied.

A fuel injection valve according to the present invention is configured in such a way that there is provided a valve body that makes contact with or departs from a seat surface of a valve seat, and when in response to an operation signal from a control system, the valve body is operated so as to depart from the seat surface of the valve seat, a fuel passes between the valve body and the seat surface of the valve seat and then is injected outward from a plurality of injection holes provided in an injection hole plate fixed to the valve seat; the fuel injection valve is characterized in that the seat surface of the valve seat is formed in such a way that the inner diameter thereof decreases in a direction from an upstream side to a downstream side of a flow of the fuel; the injection hole plate is disposed opposing a front end portion of the valve body in such a way that a virtual extension seat surface extended along the seat surface from a downstream edge of the seat surface and an upstream side face of the injection hole plate intersect each other to form a virtual circle, and is provided with a protrusion portion where a segment thereof that opposes the front end portion of the valve body protrudes downstream with a predetermined gap from the surface of the front end portion of the valve body; the protrusion portion is provided in the injection hole plate in such a way as to be situated radially inside the virtual circle; each of the plurality of injection holes provided in the injection hole plate is formed in such a way that the diameter thereof is constant from an injection hole inlet that opens at the upstream side face of the injection hole plate to an injection hole outlet; the injection hole inlet is disposed in such a way as to be radially closer to the center axis of the valve seat than the injection hole outlet; the center of the injection hole inlet that opens at the upstream side face of the injection hole plate is disposed radially inside the inner wall of the opening portion, of the valve seat, that has the minimum inner diameter of the valve seat, and radially outside the protrusion portion; at the downstream side face of the injection hole plate, there is provided a plurality of concaves arranged corresponding to the plurality of injection holes, in such a way that the length of the injection hole that is situated radially farther from the center axis of the valve seat is shorter than the length of the injection hole that is situated radially closer to the center axis of the valve seat; the concave is formed to be circular; at least part of the injection hole outlet opens at the plain of the concave; the rest of the injection hole outlet opens at the downstream side face of the injection hole plate or makes contact with the inner surface of the concave; in a flow path formed by the injection hole, there is provided a cylindrical portion, whose cross section is the radially minimum cross section of the injection hole, from the upstream side face of the injection hole plate to the plain of the concave; and assuming that L1 denotes the length of the major axis of the injection hole at the downstream side face of the injection hole plate and L2 denotes the length of a portion, of the injection hole, that is stridden over by the concave at the downstream side face of the injection hole plate, the relationship $0.3<(L2/L1)\leq 1.0$ is satisfied.

In the fuel injection valve according to the present invention, in a flow path formed by the injection hole, there is provided a cylindrical portion, whose cross section is the radially minimum cross section of the injection hole, from the upstream side face of the injection hole plate to the plain of the concave; and assuming that D1 denotes the diameter of the injection hole and D2 denotes the diameter of the concave or the diameter of the concave in the circumferential direction of the virtual circle, the relationship $1.1<(D2/D1)<3.0$ is satisfied. As a result, atomization of the fuel is facilitated, and it is made possible that small-turbulence fuel, keeping a fast flow rate, is made to flow into the injection hole and while the fuel is pushed against the inner wall of the injection hole that is situated radially inside the valve seat, the fuel that has been efficiently atomized at each injection hole is injected; therefore, both the directivity and the atomization of the spray can concurrently be satisfied.

In the fuel injection valve according to the present invention, in a flow path formed by the injection hole, there is provided a cylindrical portion, whose cross section is the radially minimum cross section of the injection hole, from the upstream side face of the injection hole plate to the plain of the concave; and assuming that T1 denotes the thickness of the injection hole plate and T2 denotes the depth of the concave, the relationship $0.1<(T2/T1)<0.8$ is satisfied. As a result, the flow rate does not vary, and it is made possible that small-turbulence fuel, keeping a fast flow rate, is made to flow into the injection hole and while the fuel is pushed against the inner wall of the injection hole that is situated radially inside the valve seat, the fuel that has been efficiently atomized at each injection hole is injected; therefore, both the directivity and the atomization of the spray can concurrently be satisfied.

In the fuel injection valve according to the present invention, in a flow path formed by the injection hole, there is provided a cylindrical portion, whose cross section is the radially minimum cross section of the injection hole, from the upstream side face of the injection hole plate to the plain of the concave; and assuming that L1 denotes the length of the major axis of the injection hole at the downstream side face of the injection hole plate and L2 denotes the length of a portion, of the injection hole, that is stridden over by the concave at the downstream side face of the injection hole plate, the relationship $0.3<(L2/L1)\leq 1.0$ is satisfied. As a result, the flow rate does not vary and both the directivity and the atomization of the spray can concurrently be satisfied.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Embodiment 1

Figure 1:
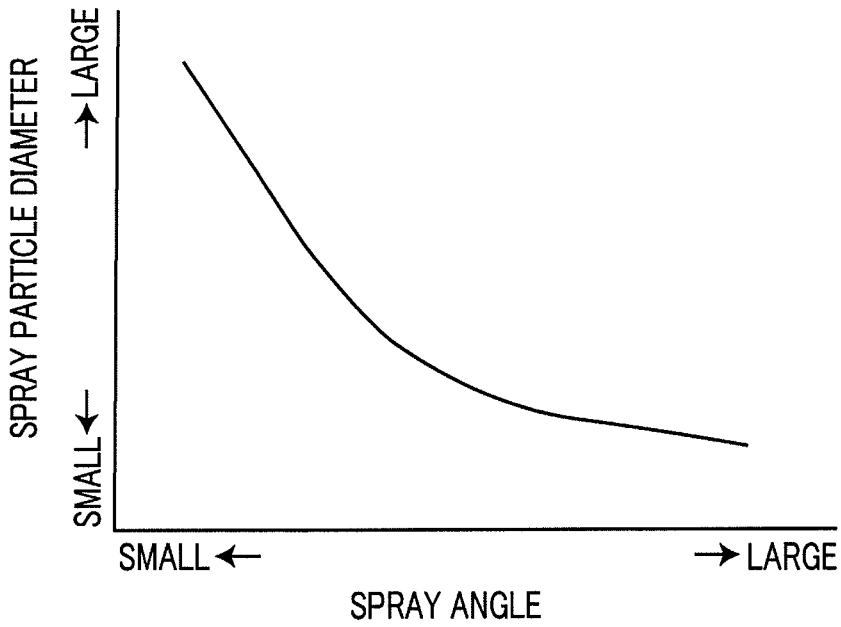
FIG. 1 is an explanatory graph representing the relationship between the fuel spray angle of a fuel injection valve and the fuel particle diameter.
Figure 2:
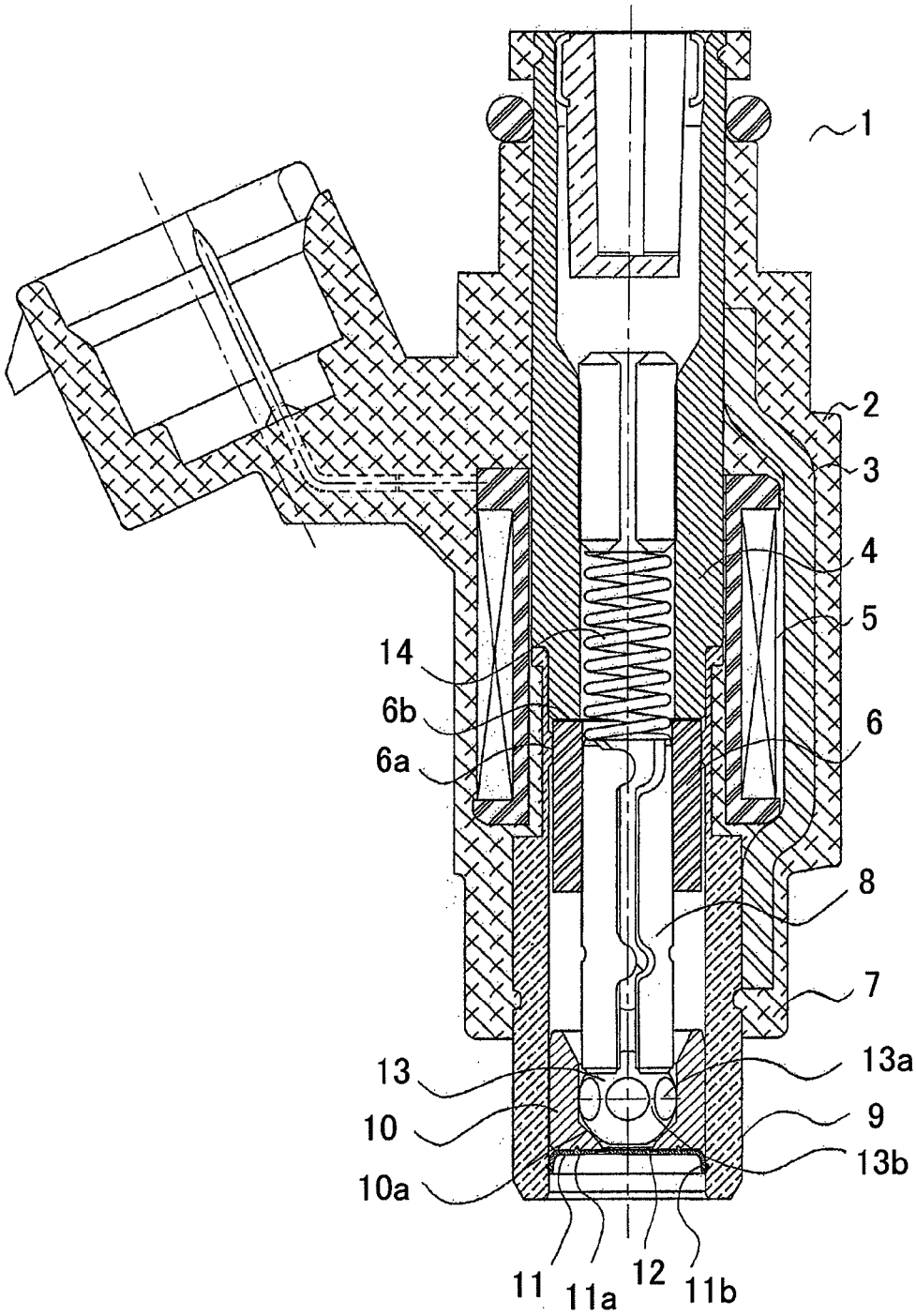
FIG. 2 is a cross-sectional view illustrating a fuel injection valve according to Embodiment 1 of the present invention.

FIG. 2 is a cross-sectional view illustrating a fuel injection valve according to Embodiment 1 of the present invention. In FIG. 2, a fuel injection valve 1 is provided with a solenoid device 2, a housing 3 which is a yoke portion of a magnetic circuit, a core 4 which is a fixed iron core portion of the magnetic circuit, a coil 5, an armature 6 which is a moving core portion of the magnetic circuit, and a valve device 7. The valve device 7 is configured with a cylindrical valve body 8 having a ball-shaped front end portion 13 at the front end thereof, a valve main body 9, and a valve seat 10.

The valve main body 9 is pressed onto the end portion outer circumferential surface of the core 4 and then is welded and fixed on the core 4. The armature 6 is pressed onto the valve body 8 and then is welded and fixed on the valve body 8. At the downstream side of the valve seat 10, an injection hole plate 11 is welded and combined with the valve seat 10 at a welding portion 11*a*. The valve seat 10, with the downstream side of which the injection hole plate 11 is combined, is inserted into the valve main body 9 and then is welded and combined with the valve main body 9 at a welding portion 11*b*. As described later, in the injection hole plate 11, there is provided a plurality of injection holes 12 that penetrate the injection hole plate 11 in the plate thickness direction thereof.

When an operation signal is transmitted from an engine control unit (unillustrated) to a drive circuit (unillustrated) for the fuel injection valve 1, the coil 5 of the fuel injection valve 1 is energized; magnetic flux is produced in the magnetic circuit configured with the armature 6, the core 4, the housing 3, and the valve main body 9; the armature 6 is attracted toward the core 4; then, the valve body 8 that is integrated with the armature 6 departs away from a seat surface 10*a* of the valve seat 10 and hence a gap is formed. Accordingly, the fuel is injected from a plurality of injection holes 12, described later, into an engine intake pipe after traveling from a plurality of grooves 13*a* provided in the front end portion 13 of the valve body 8 to the plurality of injection holes 12 through the gap between the seat surface 10*a* of the valve seat 10 and the valve body 8.

Next, when an operation stop signal is transmitted from the engine control unit to the drive circuit for the fuel injection valve 1, the energization of the coil 5 is stopped; the magnetic flux in the magnetic circuit decreases, and a compression spring 14, which biases the valve body 8 in such a way as to close the valve body 8, closes the gap between the valve body 8 and the seat surface 10*a* of the valve seat 10; then, fuel injection is ended. The valve body 8 slides on the inner circumferential surface of the valve main body 9 by the intermediary of a guide portion 6*a* of the armature 6; when the valve is opened, a top side 6*b* of the armature 6 makes contact with the bottom side of the core 4.

Figure 3:
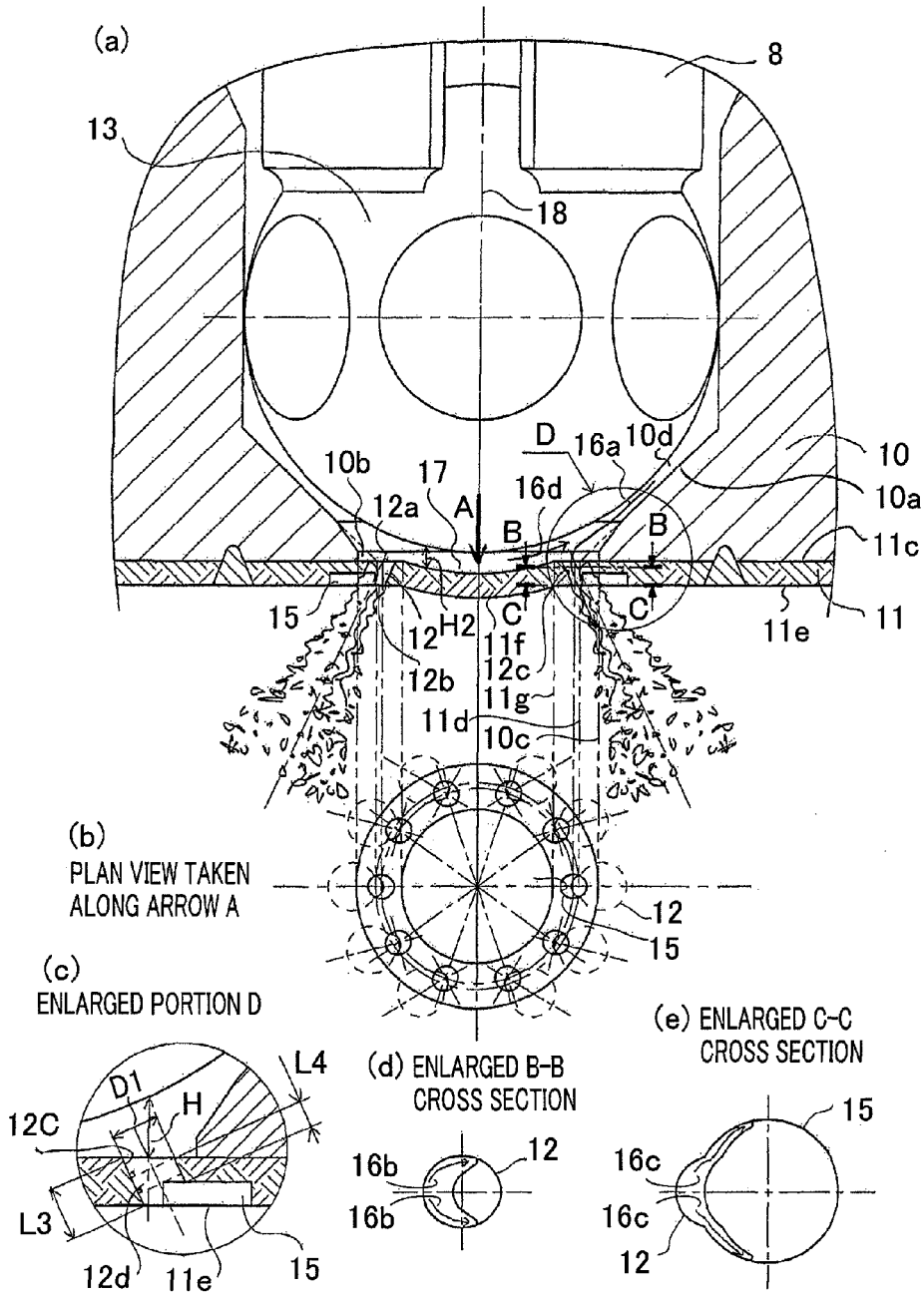
FIG. 3 is a set of explanatory views illustrating the detail of the front end portion of a fuel injection valve according to Embodiment 1 of the present invention.

FIG. 3 is a set of explanatory views illustrating the detail of the front end portion of a fuel injection valve according to Embodiment 1 of the present invention; FIG. 3(*a*) is a cross-sectional view; FIG. 3(*b*) is a plan view taken along the arrow A in FIG. 3(*a*); FIG. 3(*c*) is an enlarged view of the portion D; FIG. 3(*d*) is an enlarged cross-sectional view taken along the B-B line; and FIG. 3(*e*) is an enlarged view taken along the C-C line. In FIG. 3, the valve seat 10 is formed in such a way that the inner diameter thereof decreases in the downstream direction; the inner circumferential surface thereof is the seat surface 10*a*. The injection hole plate 11 is disposed in such a way that the extended line of the seat surface 10*a* of the valve seat 10 and an upstream side face 11*c* of the injection hole plate 11 intersect each other and a single virtual circle 11*d* is formed.

At the center portion of the injection hole plate 11, there is provided, in the radially inner side of the virtual circle 11*d*, a protrusion portion 11*f* that is approximately axisymmetric with respect to the valve seat axis 18 and whose cross section is arc-shaped and protrudes downstream in parallel with the valve-body front end portion 13. The diameter of each of a plurality of injection holes 12 provided in the injection hole plate 11 is constant from an injection hole inlet 12*a* to an injection hole outlet 12*b*; the injection hole is formed in such a way that the injection hole inlet 12*a* is situated to be closer to the center axis of the valve seat 10 than the injection outlet 12*b*. On the upstream side face 11*c* of the injection hole plate 11, the center of each of the plurality of injection holes 12 is disposed radially inside the inner wall 10*c* of the opening portion, of the valve seat, that has the minimum inner diameter of the valve seat 10, and is disposed radially outside the protrusion portion 11*f*.

In Embodiment 1, as well illustrated in the enlarged view of the portion D in FIG. 3(*c*), on the upstream side face 11*c* of the injection hole plate 11, the diameter D1 of the injection hole 12 and an injection hole right above height H, expressed by the distance in the direction of the valve seat axis 18 between the center of each of the plurality of injection holes 12 and the valve-body front end portion 13, are in the relationship H≤1.5D1 when the valve body opens. Accordingly, there can be reduced a cavity height H2 expressed by the distance in the direction of the valve seat axis 18 between the upstream side face 11*c* of the injection hole plate 11 and the valve-body front end portion 13. As a result, when the valve closes, a volume (referred to as a dead volume, hereinafter) 17 enclosed by the valve-body front end portion 13, the valve seat 10, and the injection hole plate 11 is reduced; therefore, the amount of the fuel, in the dead volume 17, that vaporizes under a high-temperature and negative-pressure condition is small, whereby the change in the flow rate characteristics (the static flow rate and the dynamic flow rate) can be suppressed from being caused by the change in the temperature or the ambient pressure.

The cavity height H2 expressed by the distance in the direction of the valve seat axis 18 between the upstream side face 11*c* of the injection hole plate 11 and the valve-body front end portion 13 is approximately constant from the center of the injection hole plate 11 to a radially outmost portion 11*g* of the protrusion portion 11*f*, but increases from the radially outmost portion 11*g* of the protrusion portion 11*f* to the inner wall 10*c* of the valve seat opening portion. Accordingly, when the valve body opens, a fuel flow 16*a* that flows into the injection hole 12 after passing through a gap 10*d* between the valve-body front end portion 13 and the seat surface 10*a* of the valve seat passes by a plurality of neighboring injection holes 12, flows toward the center of the injection hole plate 11, and then turns around at the center portion of the injection hole plate 11, so that the fuel flow 16*a* can crawl under a U-turn flow 16*d* that is issued from the radially outmost portion of the protrusion portion 11*f*, along the cavity form of the protrusion portion 11*f*. As a result, the fuel flow 16*a*, keeping a rapid flow rate, flows into the plurality of injection holes 12 without colliding head on with the U-turn flow 16*d* and then is injected to the outside of the injection hole 12 after being pushed against the injection hole inner wall 12*c* that is radially closer to the valve seat 10; thus, the directivity of the fuel spray can be secured.

In a downstream side face 11*e* of the injection hole plate 11, there are formed two or more concaves 15 that overlap with respective parts of the corresponding injection holes 12. As a result, the length L4 of the injection hole that is radially farther from the center axis of the valve seat 10 is shorter than the length L3 of the injection hole that is radially closer to the center axis of the valve seat 10.

Figure 4:
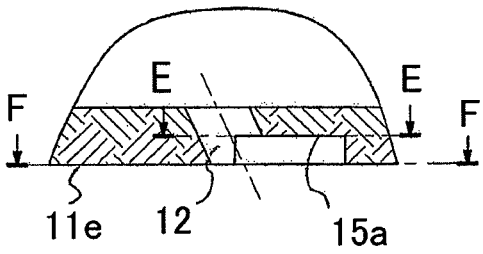
FIG. 4 is a set of explanatory views illustrating an injection hole portion of a fuel injection valve according to Embodiment 1 of the present invention.
Figure 4:
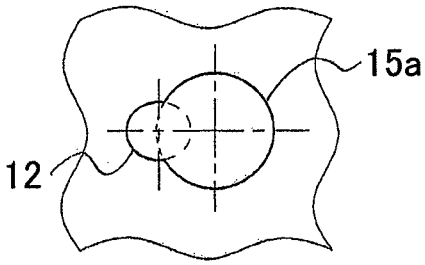
Figure 4:
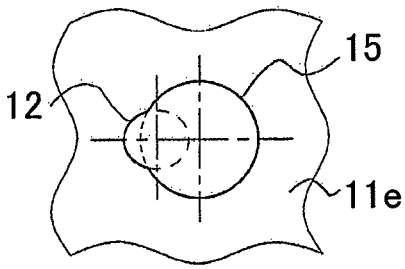
Figure 4:
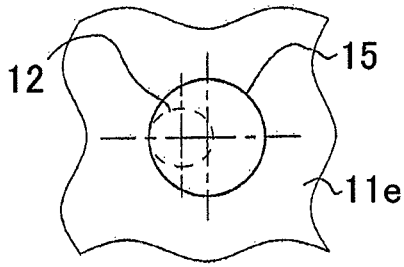

FIG. 4 is a set of explanatory views illustrating an injection hole portion of a fuel injection valve according to Embodiment 1 of the present invention; FIG. 4(*a*) is a cross-sectional view; FIG. 4(*b*) is a cross-sectional view taken along the E-E line; FIG. 4(*c*) is a cross-sectional view taken along the F-F line; FIG. 4(*d*) is an variant example of Embodiment 1 of the present invention. As illustrated in FIG. 4(*b*), on the plain 15*a* of the concave 15, part of the injection hole 12 opens to the plain 15*a* of the concave. As illustrated in FIG. 4(*c*), on the downstream side face 11*e* of the injection hole plate 11, part of the injection hole 12 opens to the downstream side face 11*e* of the injection hole plate 11.

As illustrated in FIG. 4(*d*), it may be allowed that on the downstream side face 11*e* of the injection hole plate 11, the injection hole 12 is inscribed around the concave 15.

In FIG. 3, the fuel flow 16*a* that has flown into the injection hole 12 is pushed against the inner wall 12*c*, of the injection hole, that is radially closer to the center of the valve seat 10 to be converted into a fuel flow 16*b* that is along the curvature of the inner wall of the injection hole 12, and then becomes a crescent-shaped thin liquid film in the injection hole 12, as illustrated in FIG. 3(*d*). After that, when the fuel that has become a thin film flows into the concave 15, the diameter of the injection hole is enlarged; thus, as illustrated in FIG. 3(*e*), the fuel flow becomes a flow 16*c* that is along the curvatures of the injection hole and the concave; then, because the liquid film is further widened, the fuel becomes a thin film. As a result, the fuel is injected without traveling around the inside the injection hole 12; therefore, the atomizing of the spray can be facilitated.

In Embodiment 1, each of the plurality of injection holes 12 is disposed in such a way that the center thereof is situated radially inside the virtual circle 11*d*. As a result, because the fuel flow that heads for the valve seat axis 18 is reinforced, the fuel that has flown into the injection hole 12 is more strongly pushed against the inner wall 12*c* of the injection hole; thus, the thinning of the liquid film in the injection hole is enhanced.

Furthermore, in the flow path inside the injection hole 12, there is secured a cylindrical portion 12*d*, which has the minimum cross section, from the upstream side face 11*c* of the injection hole plate 11 to the concave 15. Accordingly, the flow rate of the fuel is determined by the cross-sectional area of the cylindrical portion 12*d*; therefore, there can be suppressed the flow rate variation caused by a variation in the position of the injection hole 12 or the concave.

Figure 5:
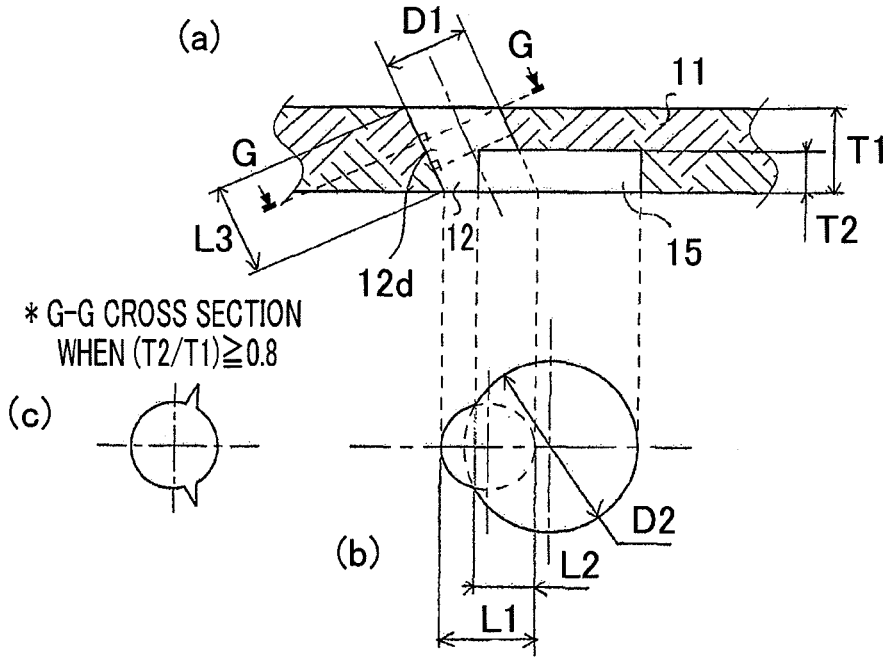
FIG. 5 is a set of explanatory views for explaining the optimum values of the respective dimensions of a concave with respect to an injection hole plate and an injection hole of a fuel injection valve.

Next, there will be explained the respective dimensions, of the concave 15 with respect to the injection hole plate 11 and the injection hole 12, that are set in such a way as to satisfy both the directivity and the atomization of the fuel spray. FIG. 5 is a set of explanatory views for explaining the optimum values of the respective dimensions of the concave with respect to the injection hole plate of the fuel injection valve and the injection hole; FIG. 5(*a*) is a cross-sectional view of principal parts of the injection hole plate; FIG. 5(*b*) is a plan view of the injection hole and the concave at the downstream side face of the injection hole plate; FIG. 5(*c*) is a cross-sectional view taken along the G-G line.

In FIG. 5, the respective dimensions of the injection hole plate 11, the injection hole 12, and the concave 15 are defined as follows:

the diameter of the injection hole 12: D1 the diameter of the concave 15: D2

The thickness of the injection hole plate 11: T1 the depth of the concave 15: T2 the length of the major axis of the injection hole 12 at the downstream side face of the injection hole plate 11: L1 the length of the portion, of the injection hole 12, that is stridden over by the concave 15 at the downstream side face of the injection hole plate 11 (the distance between the end portion of the injection hole, which opens at the downstream side face of the injection hole plate, and the intersection point of the major axis of the injection hole 12 with the straight line that is perpendicular to the major axis and passes through the intersection point of the injection hole 12 with the concave 15): L2

Figure 6:
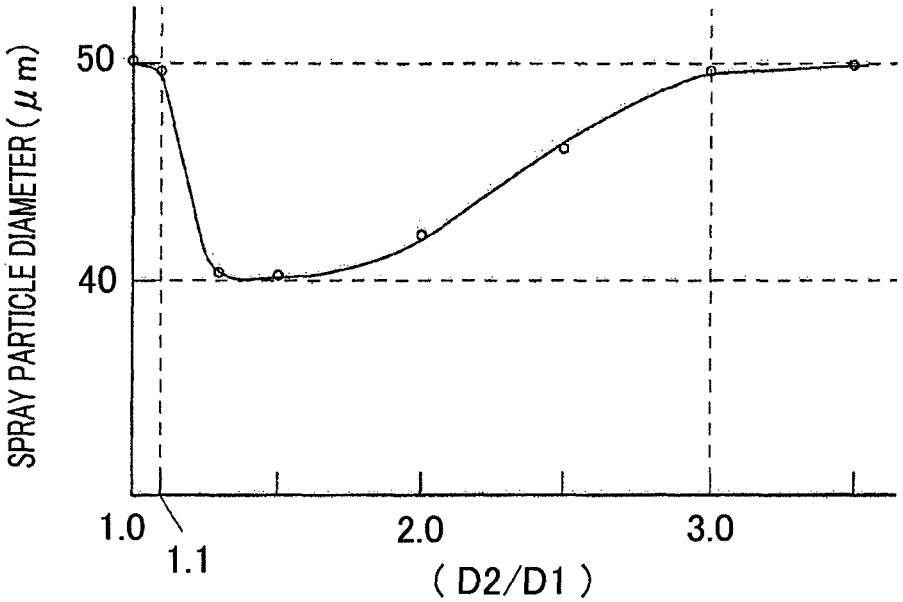
FIG. 6 is an explanatory graph representing the relationship between the ratio of the diameter of a concave to the diameter of an injection hole and the spray particle diameter.

FIG. 6 is an explanatory graph representing the relationship between the ratio of the diameter of a concave to the diameter of an injection hole and the spray particle diameter; the ordinate denotes the spray particle diameter of the fuel, and the abscissa denotes (D2/D1). The relationship, represented in FIG. 6, between the ratio of the diameter of the concave 15 to the diameter of the injection hole 12 (D2/D1) and the spray particle diameter was obtained through an experiment by the inventor of the present invention.

As can be seen from FIG. 6, when (D2/D1)□1.1, because the degree of enlargement of the injection hole diameter due to the addition of the concave 15 is small, the fuel is insufficiently thinned; when 3.0≤(D2/D1), because the difference between the curvature of the injection hole and the curvature of the concave 15 becomes large and hence the fuel departs from the injection hole 12 before being widened from the injection hole 12 to the concave 15, the fuel is insufficiently thinned. Thus, it can be seen that the atomization is facilitated only when 1.1<(D2/D1)<3.0.

Figure 7:
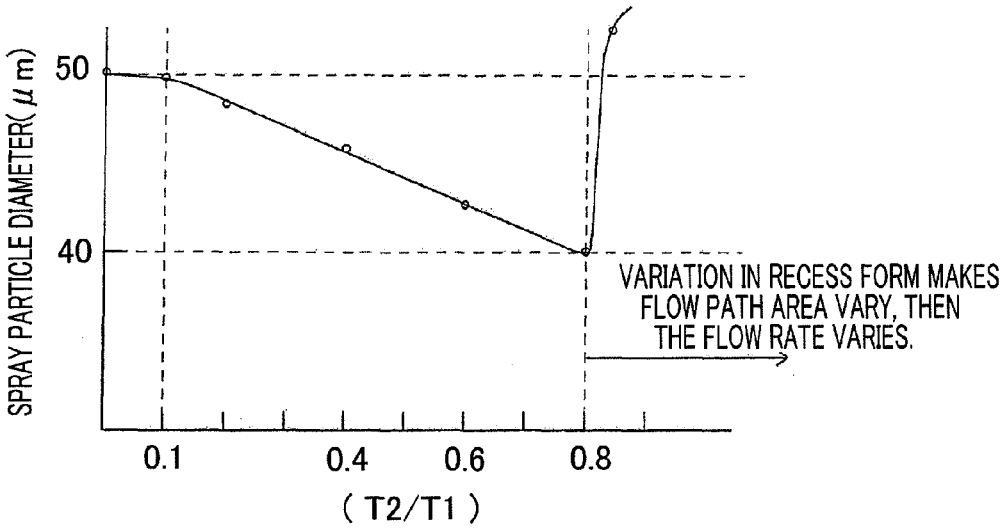
FIG. 7 is an explanatory graph representing the relationship between the ratio of the depth of a concave to the thickness of an injection hole plate and the spray particle diameter.

FIG. 7 is an explanatory graph representing the relationship between the ratio of the thickness of an injection hole plate to the depth of a concave and the spray particle diameter; the ordinate denotes the spray particle diameter, and the abscissa denotes the ratio of the depth of the concave 15 to the thickness of the injection hole plate 11 (T2/T1). The relationship, represented in FIG. 7, between the ratio of the depth of the concave 15 to the thickness of the injection hole plate 11 (T2/T1) and the spray particle diameter was obtained through an experiment by the inventor of the present invention.

As can be seen from FIG. 7, when (T2/T1)≤0.1 the fuel is injected before being thinned in the concave; when 0.8≤(T2/T1), because in the flow path inside the injection hole 12, there cannot be secured a cylindrical portion 12*d*, which has the minimum cross section, from the upstream side face 11*c* of the injection hole plate 11 to the concave 15, the shape of the injection hole at the minimum cross section portion is distorted, as illustrated in FIG. 5(*c*), whereby there exists a problem that turbulence is caused in the fuel flow and the turbulence deteriorates the particle diameter. Moreover, because variation in the concave form makes the minimum area of the flow path vary, the flow rate varies; thus, it can be seen that only when 0.1<T2/T1)<0.8, the atomization is facilitated without variation in the flow rate.

Figure 8:
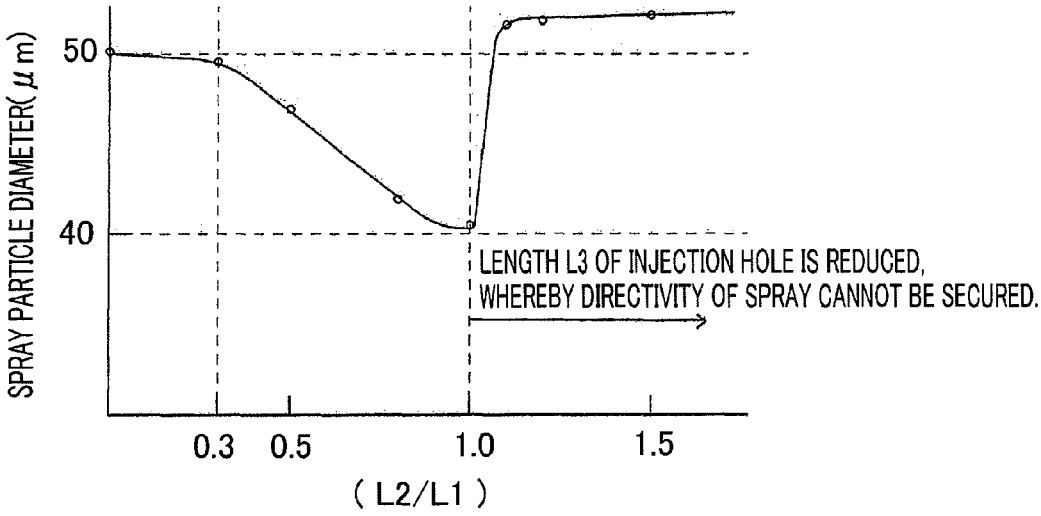
FIG. 8 is an explanatory graph representing the relationship between the ratio of the portion, of an injection hole, that is stridden over by a concave and the spray particle diameter.

FIG. 8 is an explanatory graph representing the relationship between the ratio of the portion, of an injection hole, that is stridden over by a concave and the spray particle diameter; the ordinate denotes the spray particle diameter, and the abscissa denotes the ratio of the portion, of the injection hole 12, that is stridden over by the concave 15 (L2/L1). The relationship, represented in FIG. 8, between the ratio of the portion, of the injection hole, that is stridden over by the concave (L2/L1) and the spray particle diameter was obtained through an experiment by the inventor of the present invention.

As can be seen from FIG. 8, when (L2/L1)≤0.3, because the amount of the fuel that flows from the injection hole 12 to the concave 15 is small, the fuel is insufficiently thinned; when 1.0<(L2/L1), because the length of the injection hole that is radially closer to the center axis of the fuel injection valve becomes small and hence the fuel that flows into the injection hole is injected before being sufficiently converted into a flow that is along the curvature of the injection hole, the fuel becomes streaky spray and the particle diameter thereof is deteriorated. Moreover, the directivity of the spray cannot be secured and hence the angle of the injected spray is smaller than a desired angle; thus, it can be seen that only when 0.3<(L2/L1)≤1.0, both the directivity and the atomization of the spray are satisfied.

Figure 9:
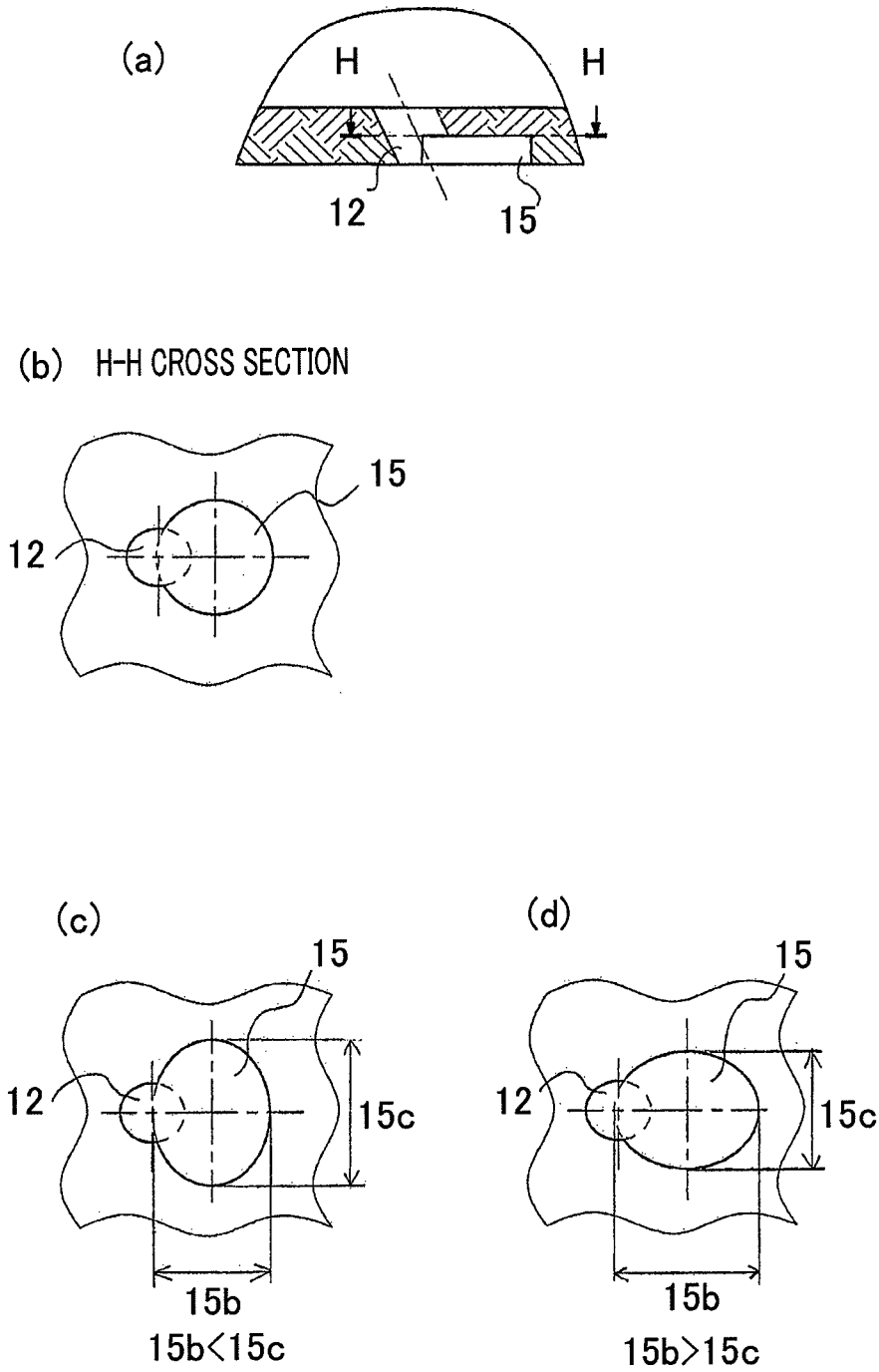
FIG. 9 is a set of explanatory views for explaining a variant example of the concave in the injection hole plate of a fuel injection valve.

Next, a variant example of the concave 15 will be explained. FIG. 9 is a set of explanatory views for explaining a variant example of the concave in the injection hole plate of a fuel injection valve; FIG. 9(*a*) is a cross-sectional view illustrating a standard variant example of the concave 15; FIG. 9(*b*) is a cross-sectional view taken along the H-H line of FIG. 9(*a*). The concave 15 illustrated in each of FIGS. 9(*a*) and 9(*b*) is formed to be approximately circular. FIG. 9(*c*) is a variant example of the concave 15 and corresponds to the cross-sectional view taken along the H-H line of FIG. 9(*a*). FIG. 9(*d*) is another variant example of the concave 15 and corresponds to the cross-sectional view taken along the H-H line of FIG. 9(*a*).

In another variant example illustrated in FIG. 9(*c*), the concave 15 is formed in such a way that the concave-axis length 15*c* in the minor-axis direction of the injection hole 12 is longer than the concave-axis length 15*b* in the major-axis direction of the injection hole 12. The concave 15 illustrated in FIG. 6(*d*) is formed in such a way that the concave-axis length 15*c* in the minor-axis direction of the injection hole 12 is shorter than the concave-axis length 15*b* in the major-axis direction of the injection hole 12. With the shape of the concave 15 in any one of these variant examples, the flow of the fuel that flows into the injection hole 12 becomes a flow that is along the curvatures of the injection hole 12 and the concave 15; therefore, the fuel can become a thin film.

In the variant example illustrated in FIG. 9(*c*), as D2 in the case where (D2/D1)≤1.1, there is utilized the major axis 15*c* of the concave 15, i.e., the major axis 15*b*, which is the diameter in the circumferential direction of the virtual circle 11*d*. In the variant example illustrated in FIG. 9(*d*), as D2 in the case where (D2/D1)≤1.1, there is utilized the minor axis 15*c* of the concave 15, i.e., the minor axis 15*c*, which is the diameter in the circumferential direction of the virtual circle 11*d*. In addition, the shape of the concave 15 may be any one of various shapes.

Embodiment 2

Figure 10:
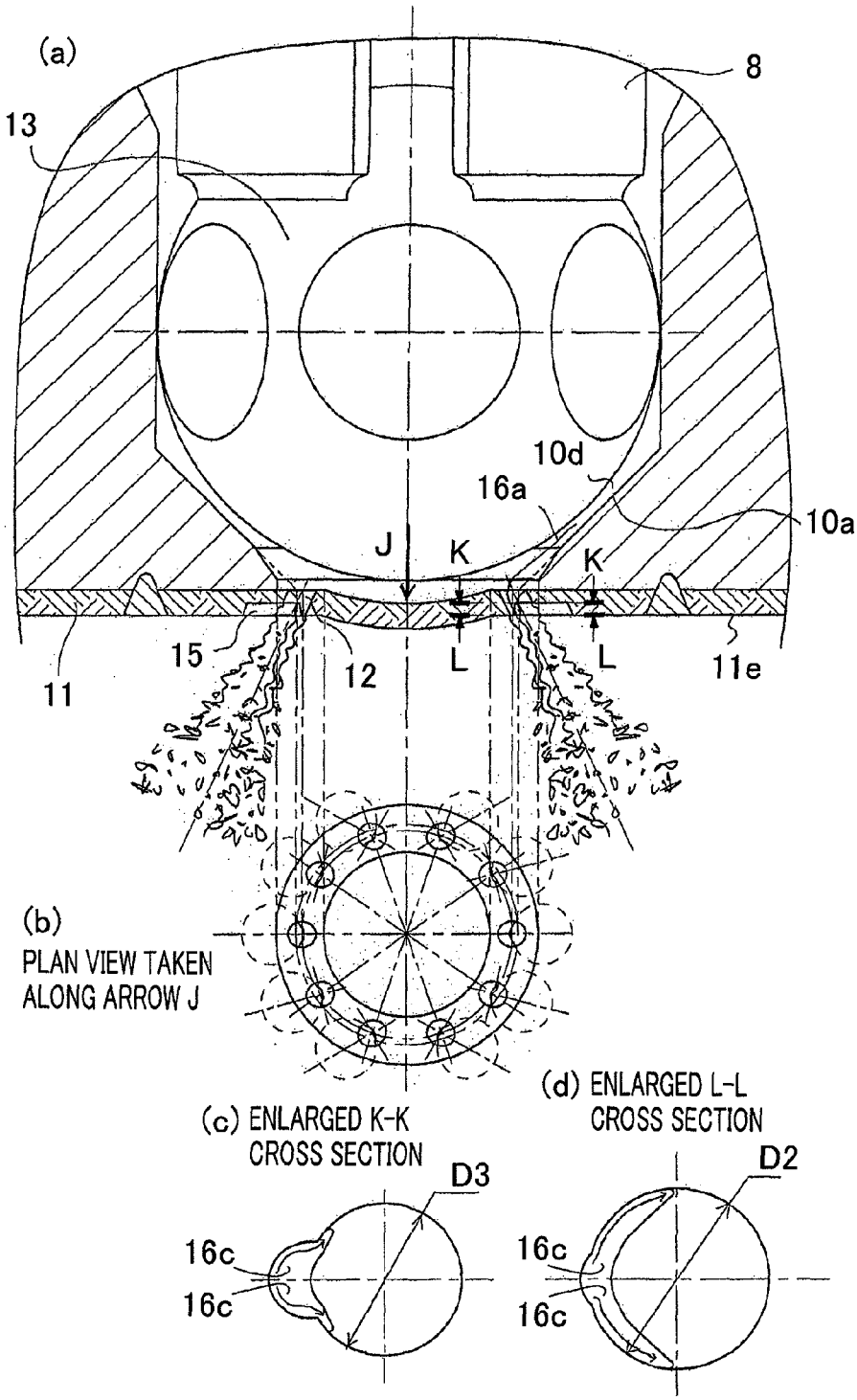
FIG. 10 is a set of explanatory views illustrating a fuel injection valve according to Embodiment 2 of the present invention.

FIG. 10 is a set of explanatory views illustrating a fuel injection valve according to Embodiment 2 of the present invention; FIG. 10(*a*) is a cross-sectional view; FIG. 10(*b*) is a plan view taken along the arrow J in FIG. 10(*a*); FIG. 10(*c*) is an enlarged cross-sectional view taken along the K-K line; and FIG. 10(*d*) is an enlarged cross-sectional view taken along the L-L line. In Embodiment 2, as illustrated in FIG. 10, the concave 15 is formed in such a way that the diameter D2 of the concave 15 that opens at the downstream side face 11*e* of the injection hole plate 11 is larger than the diameter D3 of the concave plain. The other configurations are the same as those in Embodiment 1.

With the configuration illustrated in FIG. 10, when the valve body 8 opens, the fuel flow 16*a* that has passed through the gap 10*d* between the valve-body front end portion 13 and the seat surface 10*a* of the valve seat and flown into the concave 15 can sufficiently be widened along the inner wall surface of the concave; therefore, the flow 16*c* that is along the curvatures of the injection hole 12 and the concave 15 is reinforced as the fuel travels toward the downstream side face 11*e* of the injection hole plate 11, whereby injection can be performed with the liquid film widened more thinly.

In addition, in each of Embodiments 1 and 2, described above, of the present invention, by forming the concave 15 through a forging process, it is made possible to suppress the variation in the spray with low production costs.

Various modifications and alterations of this invention will be apparent to those skilled in the art without departing from the scope and spirit of this invention, and it should be understood that this is not limited to the illustrative embodiments set forth herein.

What is claimed is:

1. A fuel injection valve in which there is provided a valve body that contacts with or departs from a seat surface of a valve seat, and in response to an operation signal from a control system, the valve body departs from the seat surface of the valve seat and a fuel passes between the valve body and the seat surface of the valve seat and then is injected outward from a plurality of injection holes provided in an injection hole plate fixed to the valve seat, wherein:

the seat surface of the valve seat has an inner diameter which decreases in a direction from an upstream side to a downstream side of a flow of the fuel;

the injection hole plate is disposed opposing a front end portion of the valve body, a line extending from a downstream edge of the seat surface intersects with an upstream side face of the injection hole plate to form a virtual circle, the injection hole plate being provided with a protrusion portion which protrudes downstream forming a predetermined gap from the surface of the front end portion of the valve body;

the protrusion portion is situated radially inside the virtual circle;

each of the plurality of injection holes provided in the injection hole plate has a constant diameter from an injection hole inlet, that opens at the upstream side face of the injection hole plate, to an injection hole outlet;

the injection hole inlet is radially closer to a center axis of the valve seat than the injection hole outlet;

a center of the injection hole inlet which opens at the upstream side face of the injection hole plate is disposed radially inside the inner wall of the opening portion, of the valve seat, that has the minimum inner diameter of the valve seat, and radially outside the protrusion portion;

at a downstream side face of the injection hole plate, there is provided a plurality of concaves arranged corresponding to the plurality of injection holes, a length of an injection hole that is situated radially farther from the center axis of the valve seat is shorter than a length of the injection hole that is situated radially closer to the center axis of the valve seat;

the concaves are each formed to be circular;

at least a part of the injection hole outlet opens at a plain of a concave and a remaining part of the injection hole outlet opens at the downstream side face of the injection hole plate or makes contact with an inner surface of the concave;

in a flow path formed by the injection hole, there is provided a cylindrical portion, whose cross section is a radially minimum cross section of the injection hole, from the upstream side face of the injection hole plate to the plain of the concave;

and a relationship 0.3<(L2/L1)≤1.0 is satisfied, where L1 denotes a length of the major axis of the injection hole at the downstream side face of the injection hole plate and L2 denotes a length of a portion, of the injection hole, that is stridden over by the concave at the downstream side face of the injection hole plate.

* * * * *